US005125613A

United States Patent [19]

Albee, Jr. et al.

[11] Patent Number: 5,125,613

[45] Date of Patent: Jun. 30, 1992

[54] EASEL

[75] Inventors: Percy F. Albee, Jr., Bristol; Riley L. Waid, Warwick, both of R.I.

[73] Assignee: Q-Panel Corporation, Providence, R.I.

[21] Appl. No.: 763,563

[22] Filed: Sep. 23, 1991

[51] Int. Cl.[5] ..... A47B 97/04

[52] U.S. Cl. ..... 248/464; 248/463; 403/91; 403/161

[58] Field of Search ..... 248/460, 463, 465, 464, 248/454; 403/91, 161, 163, 79

[56] References Cited

U.S. PATENT DOCUMENTS

| | | | |
|---|---|---|---|
| 2,550,550 | 4/1951 | Goodstein . | |
| 4,017,049 | 4/1977 | Albee | 248/465 X |
| 4,171,116 | 10/1979 | Carver | 248/464 |
| 4,326,687 | 4/1982 | Clyburn | 248/168 |
| 4,502,654 | 3/1985 | Albee | 248/168 |
| 4,609,174 | 10/1986 | Nakatani | 248/465 |

*Primary Examiner*—Blair M. Johnson

*Attorney, Agent, or Firm*—Barlow & Barlow, Ltd.

[57] ABSTRACT

Display easel having an elongated connector to which are attached three legs which can be moved from parallel storage positions to angular erection positions to form a tripod. The connector has a longitudinal passage in which slides a support rod, the movement of the legs from their storage positions to their erected positions causing the legs to lock the rod at a selected position in the passage. The legs have telescoping extensions and at least one leg has an auxiliary element that is held on the leg by a blind rivet whose head lies in a protuberance in the leg, so that its head does not interfere with sliding of the extension in the leg for adjustment.

7 Claims, 3 Drawing Sheets

EASEL

BACKGROUND OF INVENTION

It has become common practice for persons giving lectures, demonstrations, advertisements, and the like, when making a presentation before a group of people, to use large pads and charts as visual aids. In order that these aids may be seen easily by all of the audience, it has proved to be beneficial to mount them on an easel. In this way, the lecturer has his hands free for pointing or marking on the pad, while, at the same time, his audience has no difficulty in seeing his displays. The desirable features of such an easel include being compact and light in weight when dismantled for storage or transportation. A typical panel of this type is shown in the patent of Albee U.S. Pat. No. 4,017,049, where the easel takes the form of a tripod that can be collapsed when not in use. Other easels of this type are shown in the Goodstein U.S. Pat. No. 2,550,550; Carver U.S. Pat. No. 4,171,116; Clyburn U.S. Pat. No. 4,326,687; Albee U.S. Pat. No. 4,502,654; and Nakatani U.S. Pat. No. 4,609.174.

A number of difficulties have been experienced, however, in the manufacture and use of the prior art easels. For instance, while it has been convenient to use extruded aluminum tubing in the structure and to fasten with rivets, these rivets have a tendency to interfere with sliding action between telescoping parts. It has been found, also, that some of the pads and displays have a tendency to bend or fold at their upper portions; while the use of a horizontal bar can remove this problem, such a bar must be rather long and, therefore, presents a problem when one attempts to fold the easel into a compact package. These and other difficulties experienced with the prior art devices have been obviated in a novel manner by the present invention.

It is, therefore, an outstanding object of the invention to provide an easel which is particularly light in weight and can be folded into a compact package for storage and transportation.

Another object of this invention is the provision of an easel formed of aluminum tubing assembled by the use of rivets, wherein the rivets do not interfere with the sliding of telescoping parts.

A further object of the present invention is the provision of an easel having excellent support for a display at its upper end, which support presents no problem when collapsing the structure.

Another object of the invention is the provision of an easel having a horizontal upper support bar, whose assembly structure does not involve complex and expensive elements.

A still further object of the invention is the provision of an easel which is simple and rugged in construction, which can be easily manufactured from readily-available materials, and which is capable of a long life of useful service with a minimum of maintenance.

It is a further object of the invention to provide a display easel which has an uncluttered and artistic appearance.

With these and other objects in view, as will be apparent to those skilled in the art, the invention resides in the combination of parts set forth in the specification and covered by the claims appended hereto.

SUMMARY OF THE INVENTION

In general, the present invention relates to a display easel which is constructed with an elongated connector having a longitudinal passage and with a pad support rod slidably received in the passage. First and second legs are attached to the connector for swinging movement about transverse axes from storage positions to erected positions. A third leg is also attached to the connector for swinging motion about a longitudinal axis from a storage position in the plane of and between the first and second legs to an erected position lying at a substantial angle to the plane. The movement of the legs to their erected positions causes an end portion of each leg to enter the passage and to make contact with the support rod to hold it in place.

More specifically, each leg consists of an upper tubular portion that has a lower tubular extension telescopingly carried therein. An auxiliary element is mounted on at least one upper leg portion, the leg and the element being formed with protrusions having apertures through which extends a blind rivet. The head of the rivet lies within the protrusion on the leg, so that it does not extend into the path of the lower leg portion as it slides in the upper leg portion.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
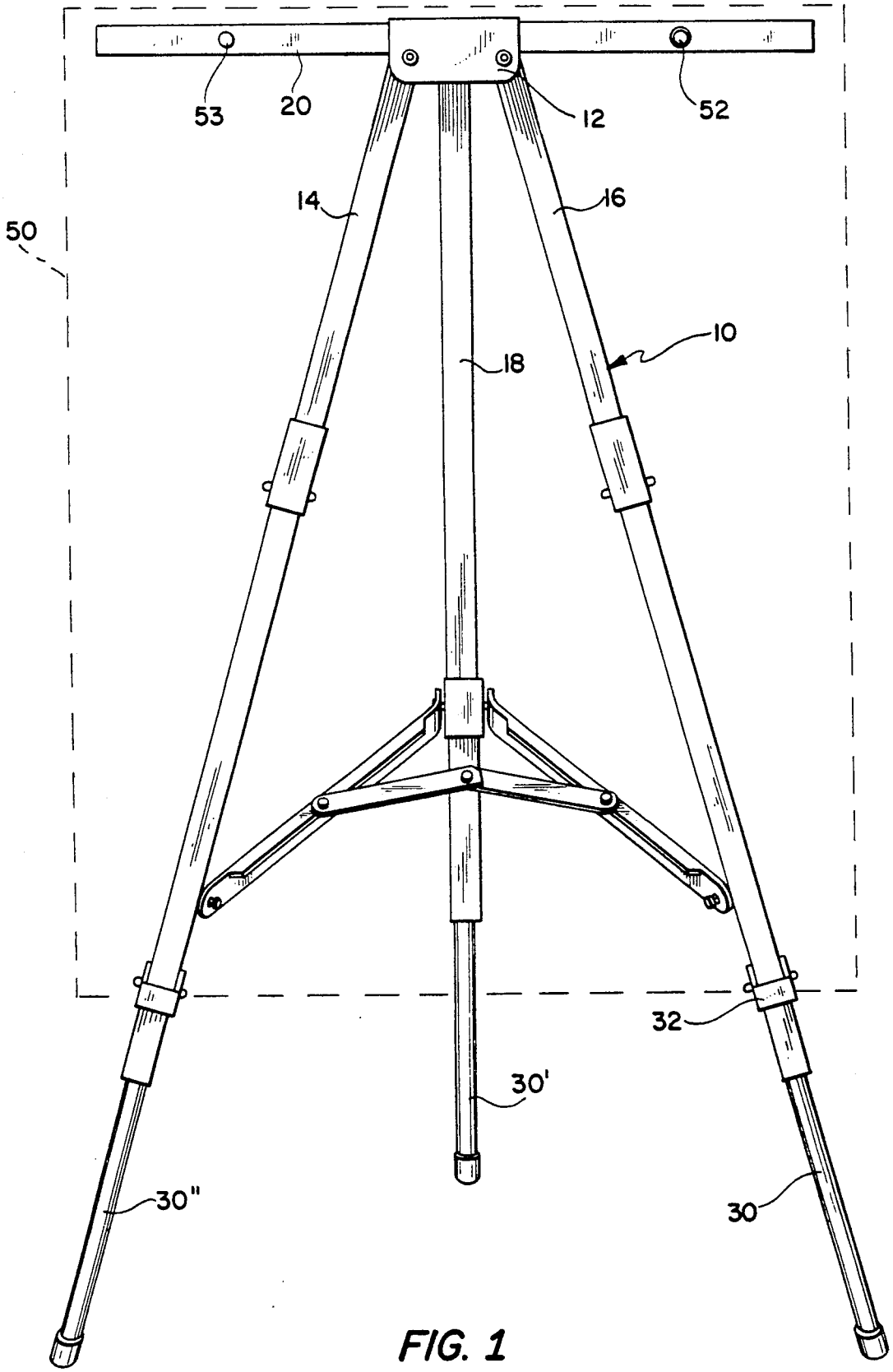
FIG. 1 is a front elevational view of an easel incorporating the principles of the present invention.
Figure 2:
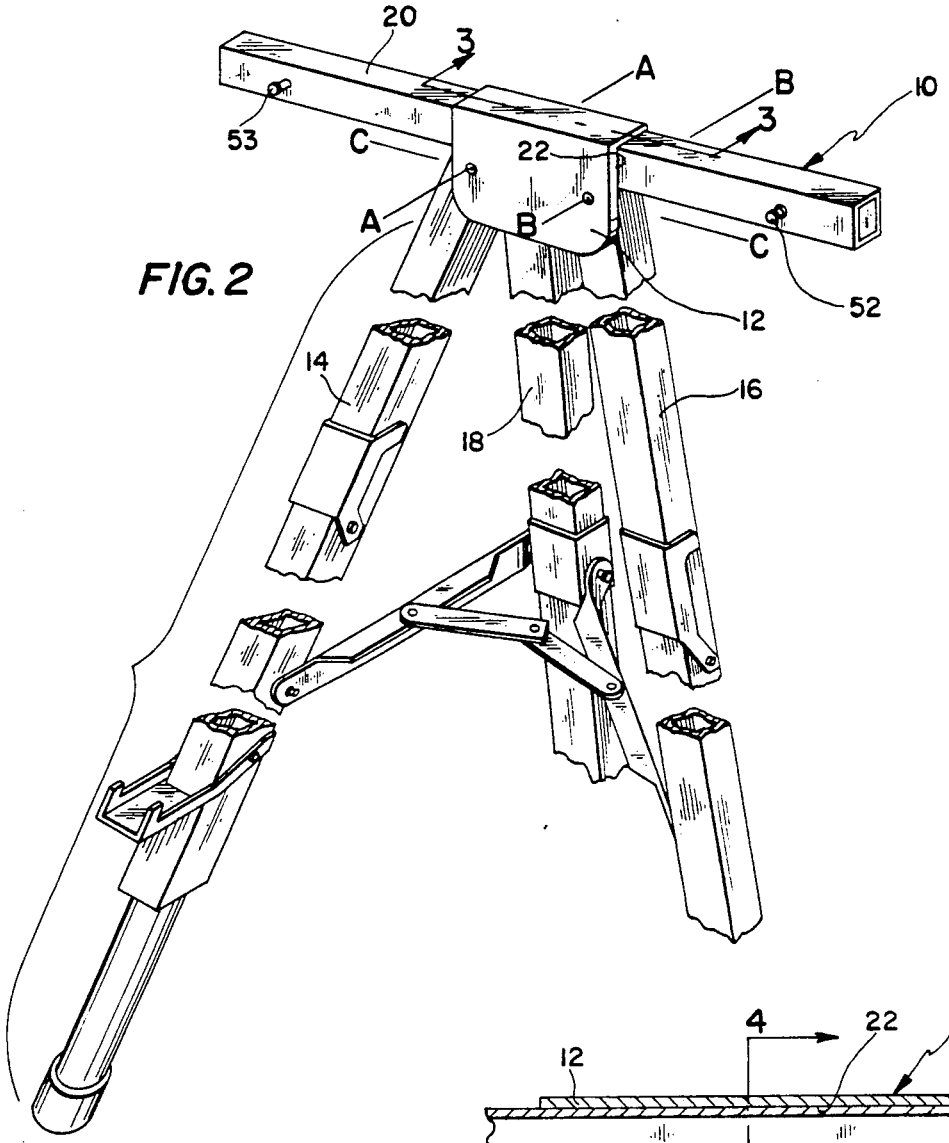
FIG. 2 is a perspective view of the invention with portions broken away.

Referring first to FIGS. 1 and 2, which best show the general features of the invention, the easel, indicated generally by the reference numeral 10, is shown as having an elongated connector 12. First and second legs 14 and 16, respectively, are pivotally connected to the ends of the connector for rotational movement in a common plane that is parallel to the front face of the connector. The rotation of the legs takes place about spaced, parallel axes A-A and B-B to move each leg from a "storage" position (where the legs lie in spaced, parallel relationship) to an "erected" position at which they lie at a substantial angle to each other.

A third leg 18 is pivotally attached to the connector 12 for pivotal movement about an axis C-C that is perpendicular to the pivotal axes of the first and second legs. This leg is moveable from a storage position between the first and second legs to an erected position that lies at a substantial angle to the said common plane. A support rod 20 is slidably carried by and extends through the connector; the rod is locked in a selected position by the legs when they are moved into their erected positions.

Figure 3:
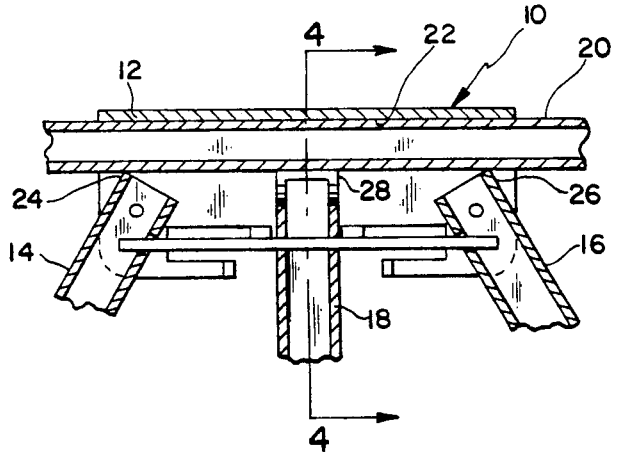
FIG. 3 is a vertical sectional view of the invention, taken on the lines 3—3 of FIG. 2.
Figure 4:
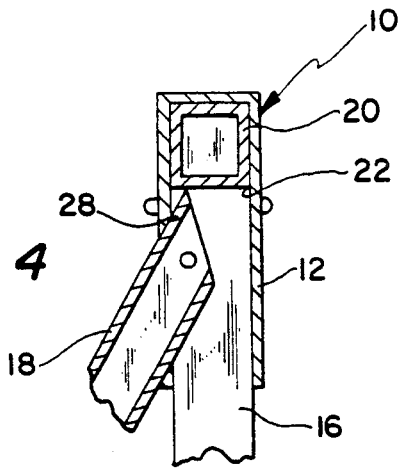
FIG. 4 is a vertical sectional view of the invention, taken on the lines 4—4 of FIG. 3.

As indicated in FIGS. 3 and 4, the elongated connector 12 has a passage 22 extending longitudinally through it. The support rod 20 is slidably carried in that passage. As indicated above, the first and second legs 14 and 16 are attached to the connector for swinging movement in a common plane about the transverse axes A-A and B-B for conversion from their storage positions to their erected positions. At the same time, the third leg 18 is attached to the connector for swinging motion about the plane of and between the first and second legs to an erected position lying at a substantial angle to the said plane. The movement of the legs to their erected positions causes the end portions 24 and 26 of the legs 14 and 16, respectively, and the end portion 28 of the leg 18 to enter the passage 22 and make contact with the support rod 20 to lock it in place.

Figure 6:
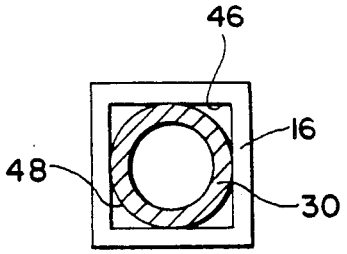
FIG. 6 is a generally horizontal sectional view of the invention, taken, on the lines 6—6 of FIG. 5.
Figure 5:
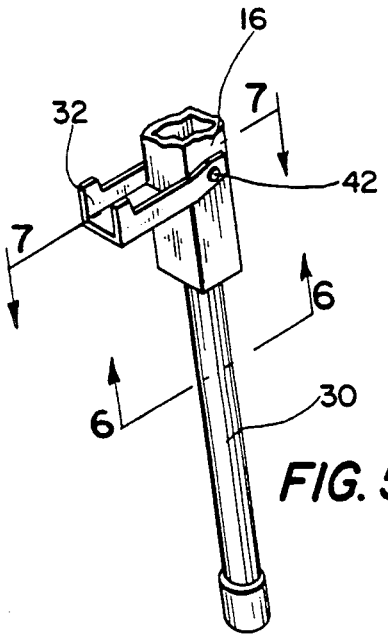
FIG. 5 is a perspective view of a portion of the easel.
Figure 7:
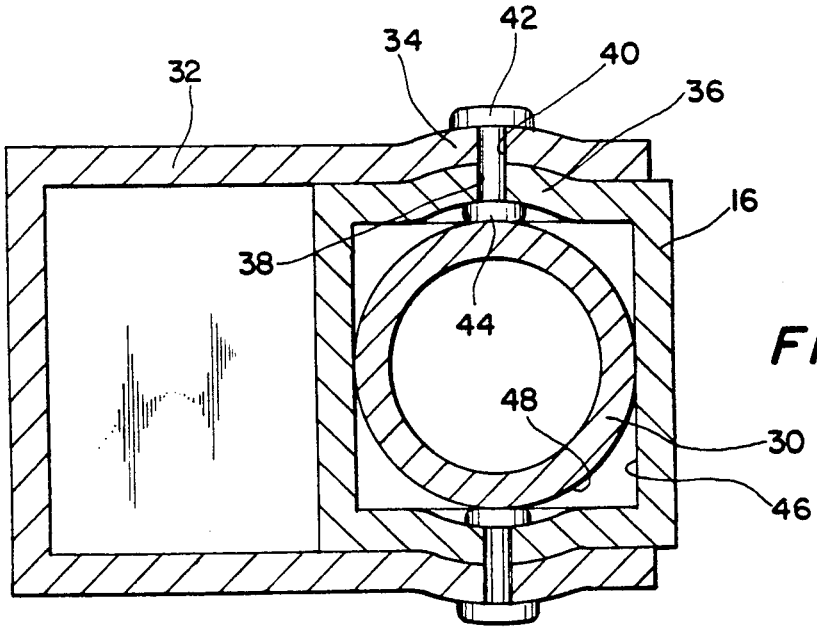
FIG. 7 is a generally horizontal sectional view of the invention, taken on the lines 7—7 of FIG. 5.

FIGS. 5, 6, and 7 show the manner in which the tubular leg 16 carries an elongated extension 30 which is telescoped in the leg and fits slidably in it for adjustment. All the legs have such an extension for determining the height of the easel. An auxiliary element 32 is mounted on the leg 16; the leg and the element are formed with nesting protrusions 34 and 36 which have central apertures 38 and 40, respectively, extending through them. A fastener 42 extends through the apertures and has a head 44 which lies in the inner cavity formed by the protrusion 36 in the leg, so that the head does not extend into the path of the extension 30 during adjustment of the total length of the leg and extension. The extension has spring-loaded detents (not shown) that engage spaced apertures on the leg to allow limited selection of length and to lock the extension in the selected position.

As shown in FIGS. 6 and 7, the leg 16 has a square cross-sectional form whose inner surface 46 makes substantial contact with the outer surface 48 of the extension 30. The extension has a circular cross-sectional shape. The fastener 42 is located adjacent one of the contact positions, where the extension would not be able to slide freely in the leg, if it were not for the present novel feature of the recessed head 44. To this end, the leg 16 is locally deformed as an outwardly directed protrusion a sufficient distance to allow the head to be received therein and not protrude beyond the planar extent of the part. Similarly the step 32 is deformed at 34 into a localized protrusion. The leg and extension are formed of aluminum and the fastener 42 is a blind rivet.

In the preferred embodiment of the invention, the auxiliary element 32 is in the form of a step on which a display can be rested. The support rod 20 is provided with pegs 52, 53 to extend through apertures formed in the display 50, while the bottom edge of the display sits on the step 32 on the leg 16 and a similar step on the leg 14. One of the pegs on the support rod is spring-loaded, so that it can be pressed into the rod to permit the rod to be introduced into the passage 22.

The operation and the advantages of the invention will now be readily understood in view of the above description. Assuming that the easel 10 is in the collapsed or storage mode, the legs 14, 16, and 18 lie side-by-side in contact with each other. At the same time, the extensions 30, 30', 30'' lie almost entirely within their respective legs. The step 32 (and the other similar elements) are folded up against the legs on which they are mounted. The braces in the intermediate portions of the legs are collapsed in the well-known manner to permit the legs to remain in the stored position. The support rod 20 is separated from the connector 12. The apparatus is, therefore, in a compact condition and, because of the use of aluminum tubing in its construction, it is very light in weight. It is also free of any danger of corrosion by exposure to rain and the elements. In addition, the presence of the support rod 20 assures that the display or chalk pad will be completely supported in such a way that its surface is flat and so that it will not fall from the easel at an inopportune moment. The use of blind rivets and outwardly deformed protrusions to attach auxiliary elements to the legs leads to an inexpensive method of assembly without inhibiting the adjustment of the extension 30 within the leg. The overall appearance of the easel is aesthetically pleasing, irrespective of whether the elements are in storage mode or in the erected, operative mode. The fact that the support rod 20 is readily removably for transport or storage does away with what would otherwise be an aggravating aspect of the prior art devices, i.e., using a complex and expensive folding mechanism for that purpose.

It is obvious that minor changes may be made in the form and construction of the invention without departing from the material spirit thereof.

The invention having been thus described, what is claimed as new and desired to secure by Letters Patent is:

1. Easel, comprising (a) an elongated connector, (b) first and second legs pivotally connected to the ends of the connector for rotational movement in a common plane about spaced, parallel axes from a storage position, at which position they lie in spaced, parallel relationship, to an erected position at which position they lie at a substantial angle to each other, (c) a third leg pivotally attached to the connector for pivotal movement about an axis that is perpendicular to the pivotal axes of the first and second legs and moveable from a storage position between the first and second legs to an erected position at a substantial angle to the said common plane, and (d) a support rod slidably extending through the connector and locked in place by the legs when they are moved into their erected positions.

2. Easel, comprising (a) an elongated connector having a passage extending longitudinally therethrough, (b) a support rod slidably carried in the passage, (c) first and second legs attached to the connector for swinging movement in a common plane about transverse axes from storage positions to erected positions, and (d) a third leg attached to the connector for swinging motion about a longitudinal axes from a storage position in the plane of and between the first and second legs to an erected position lying at a substantial angle to the said plane, the movement of the legs to their erected positions causing an end portion of each leg to enter the passage, contacting the support rod.

3. An easel having at least two tubular legs pivotally interconnected with means supporting a display comprising (a) an elongated extension carried in the leg and fitting slidably therein for adjustment;

(b) an auxiliary element mounted on the leg, the leg and the element being formed with nesting protrusions having central apertures, and (c) a fastener extending through the apertures and having a head lying within the protrusion of the leg, so that it does not protrude into the path of the extension during slidable adjustments.

4. Easel as recited in claim 3, wherein the leg has a square cross-section whose inner surface makes substantial contact with the outer surface of the extension, wherein the extension has a circular cross-section, and wherein the fastener is located adjacent the said contact.

5. Easel as recited in claim 4, wherein both leg and extension are formed of aluminum, and wherein the fastener is a blind rivet.

6. Easel as recited in claim 5, wherein the auxiliary element is a step on which a display can be rested, and wherein the support rod is provided with pegs to extend through apertures formed in the display.

7. Easel as recited in claim 6, wherein one of the pegs is spring-loaded, so that it can be pressed into the rod when the rod is to be inserted into the passage.

* * * * *